US008322415B2

(12) United States Patent
Loretz et al.

(10) Patent No.: US 8,322,415 B2
(45) Date of Patent: Dec. 4, 2012

(54) INSTRUMENTED SWELLABLE ELEMENT

(75) Inventors: Ives Loretz, Houston, TX (US); Carlos Araque, Sugar Land, TX (US); Muhammad Shafiq, Eastern Province (SA); Donald Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 468 days.

(21) Appl. No.: 12/557,769

(22) Filed: Sep. 11, 2009

(65) Prior Publication Data

US 2011/0061862 A1 Mar. 17, 2011

(51) Int. Cl.
*E21B 33/12* (2006.01)
*E21B 49/00* (2006.01)
*E21B 47/01* (2012.01)

(52) U.S. Cl. ..... 166/250.17; 166/387; 166/66; 166/191

(58) Field of Classification Search ..... 166/387, 166/191, 179, 250.01, 250.11, 250.17, 66
See application file for complete search history.

(56) References Cited

U.S. PATENT DOCUMENTS 6,050,131 A * 4/2000 Willauer ..... 73/37
6,173,788 B1 1/2001 Lembcke
6,505,682 B2 1/2003 Brockman
7,234,533 B2 6/2007 Gambier
7,322,422 B2 1/2008 Patel
7,373,991 B2 5/2008 Vaidya
7,431,098 B2 10/2008 Ohmer
7,631,697 B2 12/2009 Bhavsar
7,665,537 B2 2/2010 Patel
7,669,653 B2 3/2010 Craster
2004/0112597 A1* 6/2004 Hamid et al. ..... 166/250.17
2004/0163807 A1* 8/2004 Vercaemer ..... 166/250.12
2004/0173363 A1* 9/2004 Navarro-Sorroche ..... 166/387
2005/0199401 A1 9/2005 Patel
2007/0012436 A1 1/2007 Freyer
2007/0151724 A1* 7/2007 Ohmer et al. ..... 166/187
2008/0185144 A1 8/2008 Lovell
2008/0236271 A1* 10/2008 Zhang et al. ..... 73/152.48
2008/0308274 A1 12/2008 Macdougall
2010/0212891 A1* 8/2010 Stewart et al. ..... 166/250.12
2011/0284216 A1* 11/2011 Addis et al. ..... 166/250.01
2011/0315377 A1* 12/2011 Rioufol ..... 166/250.17

OTHER PUBLICATIONS

Examination Report issued May 1, 2012 in GB1203525.9, 2 pages.
International Preliminary Report on Patentability and Written Opinion issued in PCT/US2010/046454 on Mar. 13, 2012, 4 pages.
International Search Report in PCT/US2010/046454 on May 30, 2011, 3 pages.

* cited by examiner

*Primary Examiner* — Kenneth L Thompson
(74) *Attorney, Agent, or Firm* — Rodney Warfford; Tim Curington; Fred Pruner

(57) ABSTRACT

Apparatus and methods for deploying one or more sensors into a wellbore. The method can include at least partially embedding one or more sensors in one or more swellable elements; conveying the one or more sensors and the one or more swellable elements into the wellbore; at least partially swelling one or more of the swellable elements; and measuring at least one wellbore property with the one or more sensors.

19 Claims, 5 Drawing Sheets

INSTRUMENTED SWELLABLE ELEMENT

BACKGROUND

Hydrocarbons are produced from a wellbore that passes through one or more hydrocarbon producing formations. Packers are often used to isolate multiple hydrocarbon producing formations from one another. The performance of the packers can affect the production of hydrocarbons from the multiple hydrocarbon producing formations. Accordingly, monitoring the performance of the packers and the adjacent formations are desirable. During the production of hydrocarbons from the wellbore and/or the placement of one or more completion strings into the wellbore, one or more properties of the wellbore may need to be measured.

The properties of the wellbore are often measured with one or more sensors adjacent or integrated with the completion string. These sensors can be sensitive and susceptible to damage when exposed to wellbore fluid, debris, contact with a wall of the wellbore, or contact with a downhole object. In addition, the function of the sensors can diminish over time when the sensors are exposed to wellbore fluids continuously.

A need, therefore, exists for apparatus and methods for measuring wellbore properties and/or monitoring the performance of one or more packers while simultaneously preventing damage to the one or more sensors measuring the wellbore properties and/or monitoring the performance of one or more packers.

SUMMARY

Methods for deploying one or more sensors into a wellbore are provided. In at least one specific embodiment, a method for deploying one or more sensors into a wellbore comprises at least partially embedding the one or more sensors in one or more swellable elements; conveying the one or more sensors and the one or more swellable elements into the wellbore; at least partially swelling one or more of the swellable elements; and measuring at least one wellbore property with the one or more sensors.

An apparatus for measuring at least one property of a wellbore is also provided. In at least one specific embodiment, an apparatus for measuring at least one property of a wellbore comprises a swellable element; a sensor at least partially encapsulated by the swellable element; and a control line connected to the sensor.

A system for measuring at least one property of a wellbore is also provided. In at least one specific embodiment, a system for measuring at least one property of a wellbore comprises a tubular member; at least two packers disposed about the tubular member, wherein each packer comprises a swellable element and at least one sensor disposed within the swellable element; and at least one of a control system and a monitoring system, wherein the sensors are in communication with the control system, the monitoring system, or both.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
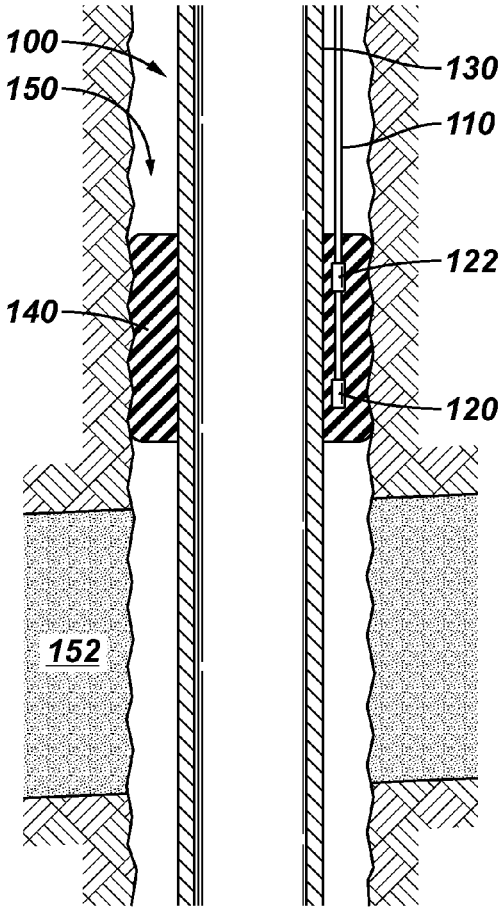
FIG. 1 depicts a schematic view of an illustrative apparatus located within a wellbore, according to one or more embodiments described.

FIG. 1 depicts a schematic view of an illustrative apparatus 100 located within a wellbore 150, according to one or more embodiments. The apparatus 100 can measure at least one property of the wellbore 150. The apparatus 100 can include one or more sensors (two are shown 120, 122) at least partially encapsulated by a swellable element 140. The swellable element 140 can be disposed on or about a tubular member 130.

The tubular member 130 can be one or more segments of blank pipe or other tubulars connected to one another. For example, the tubular member 130 can include one segment, two segments, three segments, four segments, five segments, or more than five segments. The tubular member 130 can be part of or connected to a downhole completion assembly (not shown in FIG. 1). For example, the tubular member 130 can be part of a sand control completion assembly. In one or more embodiments, the tubular member 130 can be part of a running tool and used to run one or more completion assemblies and one or more sensors 120, 122 into the wellbore simultaneously.

The swellable element 140 can be configured to be permanently installed in a wellbore 150 or the swellable element 140 can be configured to be temporarily installed in the wellbore 150. For example, the swellable element 140 can be permanently installed in the wellbore 150 by configuring the swellable element 140 to fully engage the walls of the wellbore 150 when the swellable element 140 reaches full swell, which permanently secures the tubular member 130 in the wellbore 150. The swellable element 140 can isolate one or more formations 152 adjacent the wellbore 150 from one or more portions of the wellbore 150. In one or more embodiments, the swellable element 140 can be adapted to have a full swell that provides minimal if any contact between the walls of the wellbore and the swellable element 140. As such, the tubular member 130 can be selectively removed from the wellbore 150.

The swellable element 140 can be or include any polymeric material or any other material that expands when exposed to one or more downhole triggers. The swellable element 140 can be configured to swell when exposed to a mechanical force. For example, the swellable element 140 can be an elastomeric or polymeric material used to make mechanical packers, and the swellable element 140 can radially swell when exposed to one or more forces, such as compression. The swellable element 140 can also be or include any polymeric material or any other material that reacts with one or more triggers, such as fluid type, gas, temperature, pressure, pH, electric charge, or a chemical, and expands or swells. Illustrative fluids include water, hydrocarbons, treatment fluids, or any other fluid. The polymeric material or other material used to make the swellable element 140 can include material that will react with one or more triggers to volumetrically expand or otherwise swell. Non-limiting examples of materials that can be used to make at least a portion of the swellable element 140 can include polyisoprene, polyisobutylene, polybutadiene, polystyrene, poly (styrene-butadiene), polychloroprene, polysiloxane, poly (ethylene-propylene), chorosulfonated polyethylene, and/or precursors, mixtures, and/or derivatives thereof. The swellable element 140 can also include one or more materials having different reactivity to one or more downhole triggers. For example, the swellable element 140 can include one or more of polyacrylate, polyurethane and poly (acrylonitrile-butadiene), hydrogenated poly (acrylonitrile-butadiene), polyepichlorohydrin, polysulfide, fluorinated polymers, and/or precursors, mixtures, and/or derivatives thereof. In one or more embodiments, the swellable element 140 can be or include a fluorinated polymer and polyurethane.

In one or more embodiments, the swellable element 140 can include one or more polymeric materials, other materials, or a composite of materials that have a first swellable phase that volumetrically increases when exposed to water and/or aqueous solutions and a second swellable phase that volumetrically increases when exposed to hydrocarbons. In one or more embodiments, the swellable element 140 can include a polymeric material that has at least one first component that volumetrically changes and at least one second component that is relatively volumetrically inert or constant compared to the first component when the swellable element 140 is exposed to at least one trigger. For example, the swellable element 140 can include one or more swellable polymeric materials and one or more expandable mesh-linked structures.

The swellable element 140 can also include polymeric materials comprising a copolymer derived from at least one minimally reactive monomer forming at least a portion of a low-swelling phase and at least one highly reactive monomer forming at least a portion of a high-swelling phase. Accordingly, a portion of the swellable element 140 can have a lower swelling characteristic than another portion of the swellable element 140. The swellable element 140 can also be a composite that includes at least one copolymer having a swelling phase and at least one copolymer that does not swell when exposed to the trigger. The swellable element 140 can include materials that are mechanically mixed with one another. The swellable element 140 can also include one or more materials mixed with one another and chemically stabilized. For example, the materials can be stabilized by copolymerization and/or cross-linking. The swellable element 140 can include one or more swellable materials, which can be chemically bonded with one or more non-swelling materials and/or a different swellable material, through a compound having pendant unsaturated diene bonds.

The swellable element 140 can include one or more polymeric materials that are at least partially crosslinkable. For example, the polymeric material can be formulated to include one or more crosslinking agents or crosslinkers that affect the bulk characteristics of the material without inhibiting swelling kinetics. The swellable element 140 can also include one or more reinforcing agents that impart or improve the mechanical characteristics thereof. Illustrative reinforcing agents include carbon black and silica.

In one or more embodiments, the rate at which the swellable element 140 reacts with the trigger can be increased by integrating or forming one or more transport paths and/or transport materials into the swellable element 140. Accordingly, the transport paths can increase the rate at which the triggers fully react with the swellable element 140. The transport paths can be formed by increasing the pore size and/or pore density of the material used to make the swellable element 140, integrating natural and synthetic cellulose-based substances with the material of the swellable element 140, integrating carbohydrates with the material of the swellable element 140, and/or integrating fabrics or textiles with the material of the swellable element 140.

The swellable element 140 can have a swell percentage of less than about 1%, about 1%, about 2%, about 4%, about 6%, about 8%, about 10%, about 15%, about 25%, about 40%, about 50%, about 60%, about 75%, about 85%, about 90%, about 100%, about 150%, about 200%, about 250%, about 300%, or more than 300%. For example, the swellable element 140 can include a material that swells from a first volume of two cubic feet to a second volume of four cubic feet when exposed to water, which would be a swell percentage of 100%. The swell percentage can be affected by the composition of the material, the amount of time the material is exposed to the trigger, the quantity of the trigger the material is exposed to, the concentration of the trigger exposed to the material, or any other variable that can affect a chemical reaction. The swellable element 140 can also have a swell rate that ranges from less than about 1 cubic foot per day to a more than about 100 cubic feet per day. For example, the swellable element 140 can have a swell rate of 5 cubic feet per day. In one or more embodiments, the swellable element can swell from about 10% to 200% in one day. The swell percentage and swell rate of the swellable element 140 can be pre-selected for specific applications.

In one or more embodiments, the swell rate of the swellable element 140 can be retarded by encapsulating the swellable element 140 in a barrier layer and/or otherwise manipulating the swellable element 140. The barrier layer can prevent or at least reduce the extent of exposure of the swellable element 140 to the trigger. For example, the barrier layer can comprise a water soluble material that degrades and/or dissolves in a fluid having at least one aqueous component. The barrier layer can be any water soluble material such as, but not limited to, salts, cellulose, carbohydrates, and mixtures thereof. The barrier layer can also include insoluble materials. For example, the barrier layer can comprise a hydrophobic material that provides a higher diffusion rate therethrough of non-aqueous liquids over aqueous liquids. Alternatively, the barrier layer can include a material that provides a higher diffusion rate of aqueous liquids over non-aqueous liquids.

The sensors 120, 122 can be disposed within the swellable element 140 such that the sensors 120, 122 are at least partially isolated from the wellbore 150. For example, the sensors 120, 122 can be protected from contact with the walls of the wellbore 150 and/or protected from wellbore fluids or other debris as the apparatus 100 is conveyed into the wellbore 150. The sensors 120, 122 can be selectively paired to measure properties within the wellbore 150. The properties measured by the sensors 120, 122 can be or include temperature within the wellbore 150, pressure within the wellbore 150, pH of fluids within the wellbore 150, fluid composition including but not limited to water or gas fraction, acceleration of one or more objects within the wellbore 150, fluid flow within the wellbore 150, vibrations within or adjacent the wellbore 150, or force experienced by one or more objects within the wellbore 150. Accordingly, the sensors 120, 122 can be or include accelerometers, stress gauges, strain gauges, pressure sensors, acoustic sensors, fluid type or composition sensors, thermocouples or other temperature sensors, pH sensors, or other sensors 120, 122 that can be used to measure one or more wellbore properties.

The sensors 120, 122 can be disposed within the swellable element 140 such that they are aligned along a single axis substantially parallel to the long axis of the wellbore 150 in which the apparatus 100 is disposed. The sensors 120, 122 may also be aligned in other fashions, such as, without limitation, along an axis substantially perpendicular to the long axis of the wellbore 150 in which the apparatus 100 is disposed. The sensors 120, 122 can measure certain properties within the wellbore 150 individually or independent of one another. For example, the sensor 120 can measure the temperature of the wellbore 150, and the sensor 122 can measure the pressure of the wellbore 150. Alternatively, the sensors 120, 122 can measure certain properties within the wellbore 150 relative to one another. For example, one of the sensors 120, 122 can measure the relative displacement of the sensor with respect to the other.

A control line 110 can be connected to the sensors 120, 122. The control line 110 can be used to communicate signals between the surface and the sensors 120, 122. For example, the control line 110 can be used to transmit the data measured by the sensors 120, 122 to the surface and/or the control line 110 can be used to send one or more signals to the sensors 120, 122. The signals sent to the sensors 120, 122 can instruct the sensors 120, 122 to take a measurement of the wellbore properties and/or to hibernate. The control line 110 can be in communication with one or more data storage devices and/or processors (not shown) and can provide data acquired from the sensors 120, 122 to the data storage device and/or processor. The control line 110 can also be used to send one or more signals from the sensors 120, 122 to one or more devices disposed within the wellbore. For example, if the sensors 120, 122 detect a high wellbore pressure, the sensors can send a signal to one or more flow control devices and instruct the flow control devices to open and/or close. In one or more embodiments, the sensors 120, 122 can be in wireless communication with one another, the surface, and/or other portions of the wellbore. Accordingly, the control line 110 can be removed. For example, the sensors 120, 122 can be in wireless communication with one another through radio frequency waves, acoustic waves, vibration, or by any other form of wireless telemetry.

Figure 2:
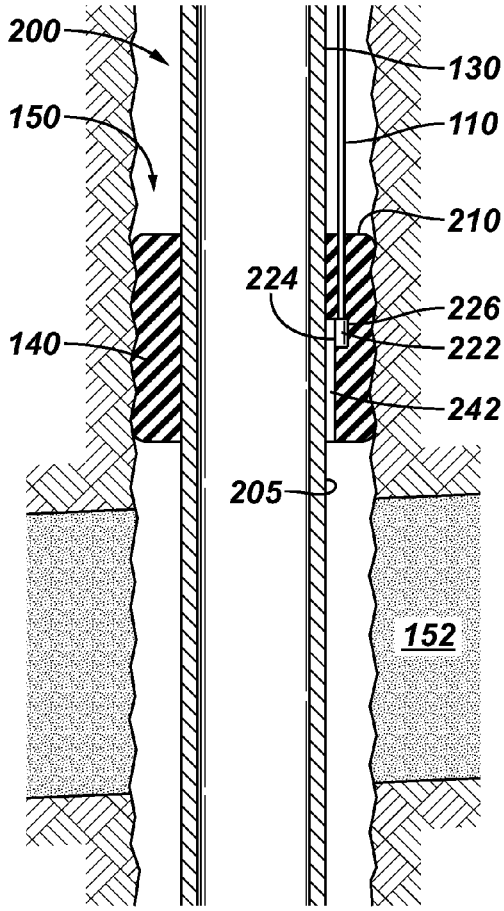
FIG. 2 depicts a schematic view of another illustrative apparatus located within a wellbore, according to one or more embodiments described.

FIG. 2 depicts a schematic view of another illustrative apparatus 200 located within the wellbore 150, according to one or more embodiments. The apparatus 200 can include one or more sensors 222 disposed within one or more swellable elements 140. The sensor 222 can be substantially similar to the sensors 120, 122 as described above. The swellable element 140 can be disposed about the tubular member 130, and one or more control lines 110 can be in communication with the sensor 222 and at least partially disposed within the swellable element 140. Furthermore, a channel 242 can be disposed within or formed into a portion of the swellable element 140.

The channel 242 can be or include a conduit integrated with the swellable element 140. For example, the channel 242 can be a conduit disposed about a portion of the swellable element 140 and in fluid communication with at least a portion of the sensor 222 and at least a portion of the wellbore 150, or a conduit at least partially inserted into the swellable element 140 and in fluid communication with at least a portion of the sensor 222 and at least a portion of the wellbore 150. In one or more embodiments, the channel 242 can be or include a groove formed into the swellable element 140 by milling, cutting, molding, or otherwise removing a portion of the swellable element 140 to selectively expose at least a portion of the sensor 222 to a portion of the wellbore 150. The channel 242 can have any cross sectional shape. For example, the cross sectional shape of the channel 242 can be square, round, triangular, or other shapes. The channel 242 can be located adjacent a first portion 205 of the apparatus 100. The channel 242 can at least partially expose a first portion 224 of the sensor 222 to a wellbore fluid. Furthermore, a second portion 226 of the sensor 222 can be isolated or encapsulated by the swellable element 140 adjacent a second portion 210 of the apparatus 200. As such, the first portion 224 of the sensor 222 can be exposed to a fluid and the second portion 226 of the sensor 222 can be protected and/or isolated from fluid and debris. In one or more embodiments, the sensor 222 can be used to measure fluid proximate the first portion 205 of the apparatus 200, and the sensor 222 can remain isolated from a fluid adjacent the second portion 210 of the apparatus 200. For example, the channel 242 can be disposed adjacent the tubular member 130, and the first portion 224 of the sensor 222 can be used to measure the temperature of fluid adjacent the tubular member 130 when the tubular member 130 is disposed within the wellbore 150, and the sensor 222 can be isolated from the temperature of the fluid between the second portion 210 of the apparatus 200 and the formation 152.

Figure 3:
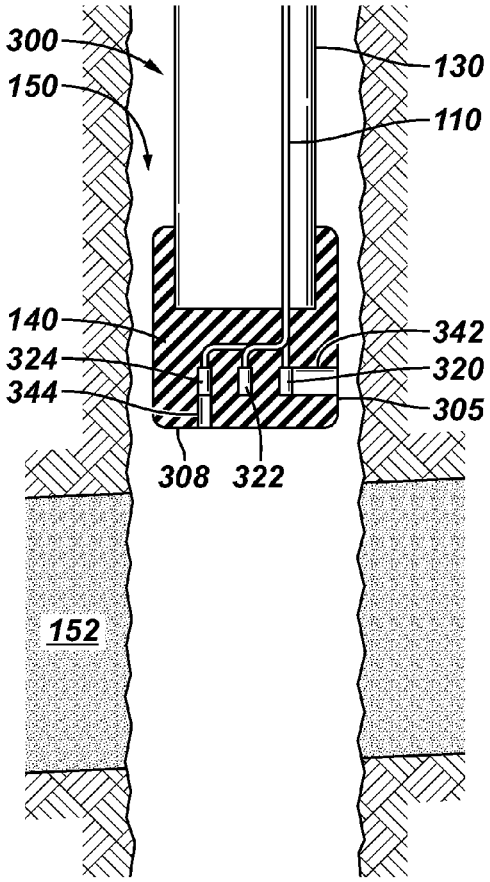
FIG. 3 depicts a schematic view of yet another illustrative apparatus located within a wellbore, according to one or more embodiments described.

FIG. 3 depicts a schematic view of yet another illustrative apparatus 300 located within wellbore 150, according to one or more embodiments. The apparatus 300 can include one or more sensors (three are shown 320, 322, 324) at least partially encapsulated by the swellable element 140. The sensors 320, 322, 324 can be substantially similar to the sensors 120, 122. The sensors 320, 322, 324 can be in communication with the communication cable 110. The swellable element 140 can be connected to the tubular member 130. The tubular member 130 can be used to convey the apparatus 300 into the wellbore 150.

The swellable element 140 can have a first notch 342 formed into a first portion 305 of the swellable element 140 and a second notch 344 formed into a second portion 308 thereof. The notches 342, 344 can contain or house the sensors 320, 324. For example, the sensors 320, 324 can be at least partially disposed within the notches 342, 344 respectively. The notches 342, 344 can protect the sensors 320, 324 from contacting the walls of the wellbore 150 or other objects in the wellbore 150. At the same time, the notches 342, 344 can also allow the sensors to contact fluids within the wellbore 150. The sensor 322 can be encapsulated by the swellable element 140. The sensor 322 can be disposed between the sensors 320, 324. The sensors 320, 322, 324 can measure different wellbore properties. For example, the sensor 320 can measure the temperature of fluid adjacent thereto; the sensor 324 can measure temperature of fluid adjacent thereto; and the sensor 322 can measure the hydrostatic pressure in the wellbore 150. In the alternative, the sensors 320, 322, 324 can measure the same wellbore properties. For example, the sensors 320, 322, 324 can measure the hydrostatic pressure within the wellbore 150. In one or more embodiments, the apparatus 300 can be located adjacent the formation 152 and one or more of the sensors 320, 322, 324 can measure one or more properties of the formation 152.

Figure 4:
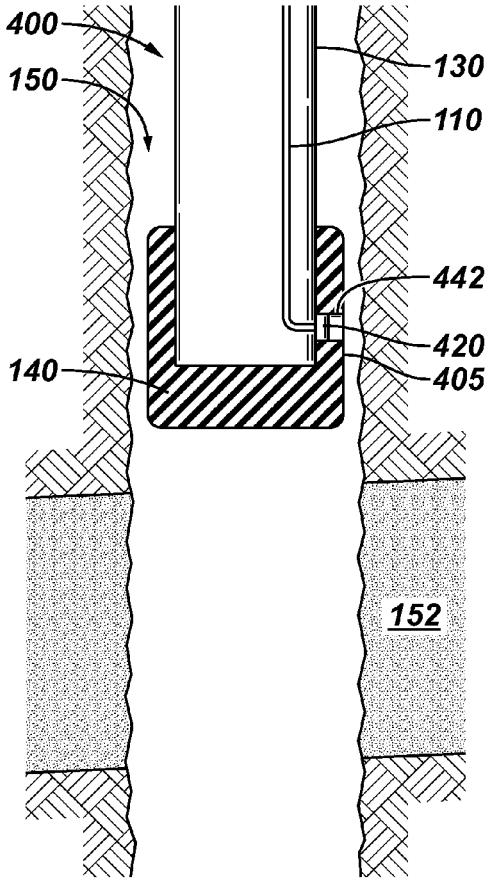
FIG. 4 depicts a schematic view of another illustrative apparatus located within a wellbore, according to one or more embodiments described.

FIG. 4 depicts a schematic view of another illustrative apparatus 400 located within the wellbore 150, according to one or more embodiments. The apparatus 400 can include one or more sensors 420 disposed on or in one or more swellable elements 140. The swellable element 140 can be connected to the tubular member 130. The sensor 420 can be substantially similar to the sensors 120, 122. The communication cable 110 can be at least partially disposed through or on the swellable element 140.

The swellable element 140 can have one or more notches 442 formed into at least a first portion 405 thereof. The notch 442 can at least partially contain the sensor 420. For example, the sensor 420 can be at least partially disposed within the notch 442. As the apparatus 400 is disposed into the wellbore 150, the notch 442 can protect the sensor 420. Furthermore, as the swellable element 140 expands, the swellable element 140 can fill the entire wellbore 150 and engage the walls of the wellbore 150, which provides a stable environment to conduct measurements of wellbore properties. For example, the sensor 420 can be disposed adjacent the formation 152 prior to the swellable element 140 reaching the maximum swell percentage. The notch 442 can isolate the sensor 420 from other portions of the wellbore 150 subsequent to the swellable element 140 reaching the maximum swell percentage. The isolation of the sensor 420 can prevent measurements of the localized area from being skewed due to contamination from other portions of the wellbore. In one or more embodiments, the sensor 420 can be disposed adjacent the formation 152, and the sensor 420 can measure the vibrations adjacent the formation 152 or the tubing string. As the sensor 420 measures the vibrations of the formation 152, the notch 442 can insulate or isolate the sensor 420 from vibrations in other portions of the wellbore 150. Accordingly, the sensor 420 can give an accurate measurement of the vibrations adjacent the formation 152 and the noise or corruption of the measurements can be limited.

Figure 5:
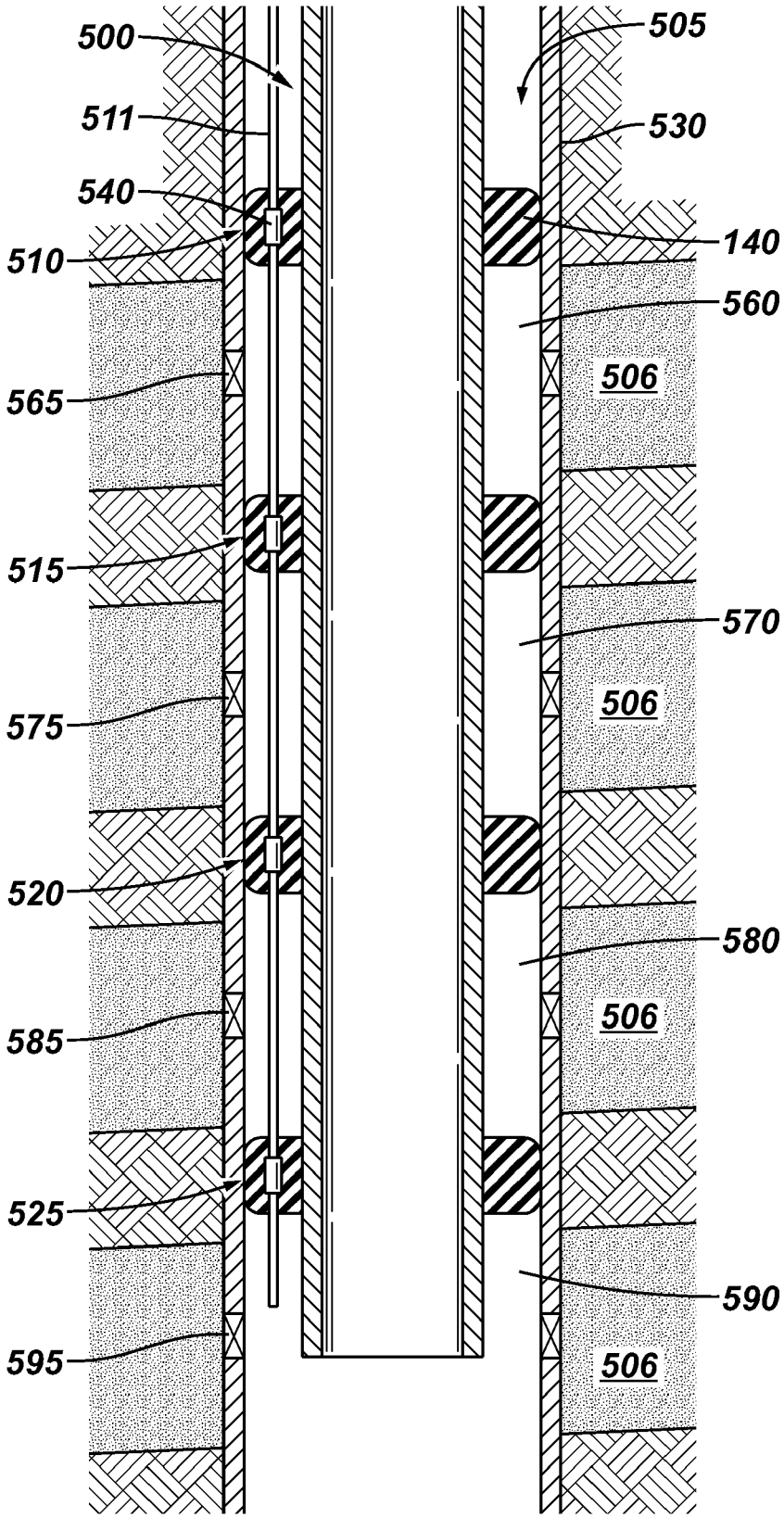
FIG. 5 depicts a schematic view of an illustrative system located within a wellbore, according to one or more embodiments described.

FIG. 5 depicts a schematic view of an illustrative system 500 located within a wellbore 505, according to one or more embodiments. The system or completion 500 can include one or more apparatus (four are shown 510, 515, 520, 525) for measuring properties of the wellbore 505. The apparatus 510, 515, 520, 525 can be the same as or similar to the apparatus described herein. The apparatus 510, 515, 520, 525 can have one or more sensors 540 and one or more swellable elements 140. The sensors 540 can be an array of sensors, a plurality of sensors, a plurality of arrays of sensors, or a single sensor. The sensors 540 can be at least partially disposed in the swellable elements 140. The swellable elements 140 can be disposed on or otherwise integrated with one or more tubular members 530. The apparatus 510, 515, 520, 525 can be connected to one another in series. The apparatus 510, 515, 520, 525 can be disposed upstream or downstream of one another and/or placed adjacent to one another. The apparatus 510, 515, 520, 525 can be in communication with the surface, one another, and/or other pieces of equipment through the communication cable 511 and/or through wireless telemetry. For example, wireless telemetry, such as electromagnetic waves or acoustic waves, can be used to send the acquired data from the apparatus 510, 515, 520, 525 to the surface, between the sensors or instructions from the surface to the apparatus 510, 515, 520, 525.

In operation, the apparatus 510, 515, 520, 525 can be assembled at the surface proximate to the wellbore 505. The apparatus 510, 515, 520, 525 can be assembled at the surface by integrating the sensors 540 with the swellable element 140. The swellable element 140 of each apparatus can be disposed about or connected to the tubular member 530 prior to integrating the sensors 540 with the swellable element 140. The swellable element 140 can be disposed about or connected to the tubular member 530 subsequent to integrating the sensors 540 with swellable element 140. The tubular member 530 can include a plurality of sections and each apparatus 510, 515, 520, 525 can be disposed about an independent section and the sections can be threaded together or otherwise connected to one another.

The sensors 540 can be integrated with the swellable element 140 by forming one or more openings into the swellable element 140 and placing the sensor 540 within the openings. The openings can be formed by cutting slits, notches, channels, or other openings into the swellable element 140. In one or more embodiments, the swellable elements 140 can be integrated with the sensors 540 during the molding of the swellable elements 140. In one or more embodiments, one or more of the apparatus 510, 515, 520, 525 can be a packer or incorporated into a packer. When the apparatus 510, 515, 520, 525 are assembled, one or more of the swellable elements 140 can be pre-swelled to provide immediate fixation upon location of the completion 500 within the wellbore 505. After the apparatus 510, 515, 520, 525 are assembled or configured at the surface, the apparatus 510, 515, 520, 525 can be connected with other tubular members (not shown) having one or more pieces of downhole completion equipment (not shown) disposed thereon. For example, the other tubular members can include sand screens, inflow control devices, setting tools, flow control devices, wash pipe, or wash shoes.

For example, one or more flow control devices 565, 575, 585, 595 and/or other completion equipment can be connected to or integrated with the tubular members 530 of the apparatus 510, 515, 520, 525. The flow control devices 565, 575, 585, 595 can be ball valves, electrically or hydraulically operated valves, go/no-go valves, diaphragm valves, needle valves, globe valves, or other valves. The flow control devices 565, 575, 585, 595 can be configured to be remotely actuated. For example, the flow control devices 565, 575, 585, 595 can be in communication with the surface and one or more signals can be sent from the surface to the flow control devices 565, 575, 585, 595, and the signals can instruct the flow control devices 565, 575, 585, 595 to close and/or open. The flow control devices 565, 575, 585, 595 can be hydraulically, electrically, or mechanically actuated. In another embodiment, one or more of the sensors 540 can be configured to send one or more signals to the flow control devices 565, 575, 585, 595 instructing the flow control devices to open and/or close when one or more predetermined conditions are measured. The predetermined conditions can be or include a specific temperature or temperature range, a specific flow rate or flow rate range, a specific pressure or pressure range, the presence of gas, or the presence of water. In one or more embodiments, the flow control devices 565, 575, 585, 595 can be controlled from the surface. For example, the flow control devices 565, 575, 585, 595 can be configured to be hydraulically operated, and one or more pressurized fluids or gases, such as hydraulic fluid or air, can be sent from the surface through a hydraulic line (not shown) to one or more of the flow control devices 565, 575, 585, 595 and used to open and/or close the flow control devices 565, 575, 585, 595.

In operation, the system 500 can be located in the wellbore 505 with a running tool (not shown), which can have one or more apparatus (not shown) connected thereto. As the system 500 is run into the wellbore 505, one or more of the sensors 540 can measure wellbore properties. Accordingly, the sensors 540 of one or more of the apparatus 510, 515, 520, 525 can measure wellbore properties at different conditions; for example, the sensors 540 of one or more of the apparatus 510, 515, 520, 525 can measure the flowing bottom hole pressure prior to full swell of the swellable elements 140 of the apparatus 510, 515, 520, 525 and shut in pressure after the swellable elements 140 of the apparatus 510, 515, 520, 525 have fully expanded. Furthermore, one or more of the sensors 540 of one or more of the apparatus 510, 515, 520, 525 can measure hydrostatic pressure without being exposed to wellbore debris or fluid. For example, the swellable elements 140 can pressurize under hydrostatic pressure, which allows one or more of the sensors 540 to be isolated from damaging fluids and provide wellbore pressure.

In one or more embodiments, the system 500 can be located in the wellbore 505 such that each of the apparatus 510, 515, 520, 525 are adjacent one or more formations 506, and an annulus can be formed between the system 500 and the formations 506. The swellable element 140 of each of the apparatus 510, 515, 520, 525 can be expanded or swelled to isolate portions of the annulus from one another, which can form multiple zones 560, 570, 580, 590.

Each zone 560, 570, 580, 590 can be in communication with or associated with one of the apparatus 510, 515, 520, 525. For example, the apparatus 510 can be associated with the zone 560; the apparatus 515 can be associated with the zone 570; the apparatus 520 can be associated with the zone 580; and the apparatus 525 can be associated with the zone 590. The wellbore properties of each zone 560, 570, 580, 590 can be independently monitored and/or measured by one or more of the sensors 540 of the apparatus 510, 515, 520, 525 associated therewith. For example, the sensors 540 of the apparatus 510, 515, 520, 525 can measure the temperature, pressure, and/or other wellbore properties of the zone 560; the sensors 540 of the apparatus 515 can measure temperature, pressure, and/or other wellbore properties of the zone 570; the sensors 540 of the apparatus 520 can measure temperature, pressure, and/or other wellbore properties of the zone 580; and the sensors 540 of the apparatus 524 can measure temperature, pressure, and/or other wellbore properties of the zone 590.

The system 500 can be used to selectively perform one or more hydrocarbon services on the zones 560, 570, 580, 590. The apparatus 510, 515, 520, 525 can provide real-time monitoring and/or feedback as one or more hydrocarbon services are performed within the wellbore 505. The hydrocarbon services can include hydrocarbon production, treatment operations, clean up operations, sand control operations, testing operations, and/or other operations to enable production or enhance production from the zones 560, 570, 580, 590 and/or the formation 506. For example, the system 500 can be configured to simultaneously produce hydrocarbons from each hydrocarbon producing zone 560, 570, 580, 590 and to discontinue production of hydrocarbons from one or more of the hydrocarbon producing zones 560, 570, 580, 590 if a predetermined condition is detected by one or more sensors 540 of the apparatus 510, 515, 520, 525. Each hydrocarbon producing zone 560, 570, 580, 590 can be in independent fluid communication with one of the flow control devices 565, 575, 585, 595. For example, hydrocarbon production from the hydrocarbon producing zone 560 can be discontinued if water is detected in hydrocarbon producing zone 560, and hydrocarbon production from the hydrocarbon producing zones 570, 580, 590 can continue undisturbed.

Figure 6:
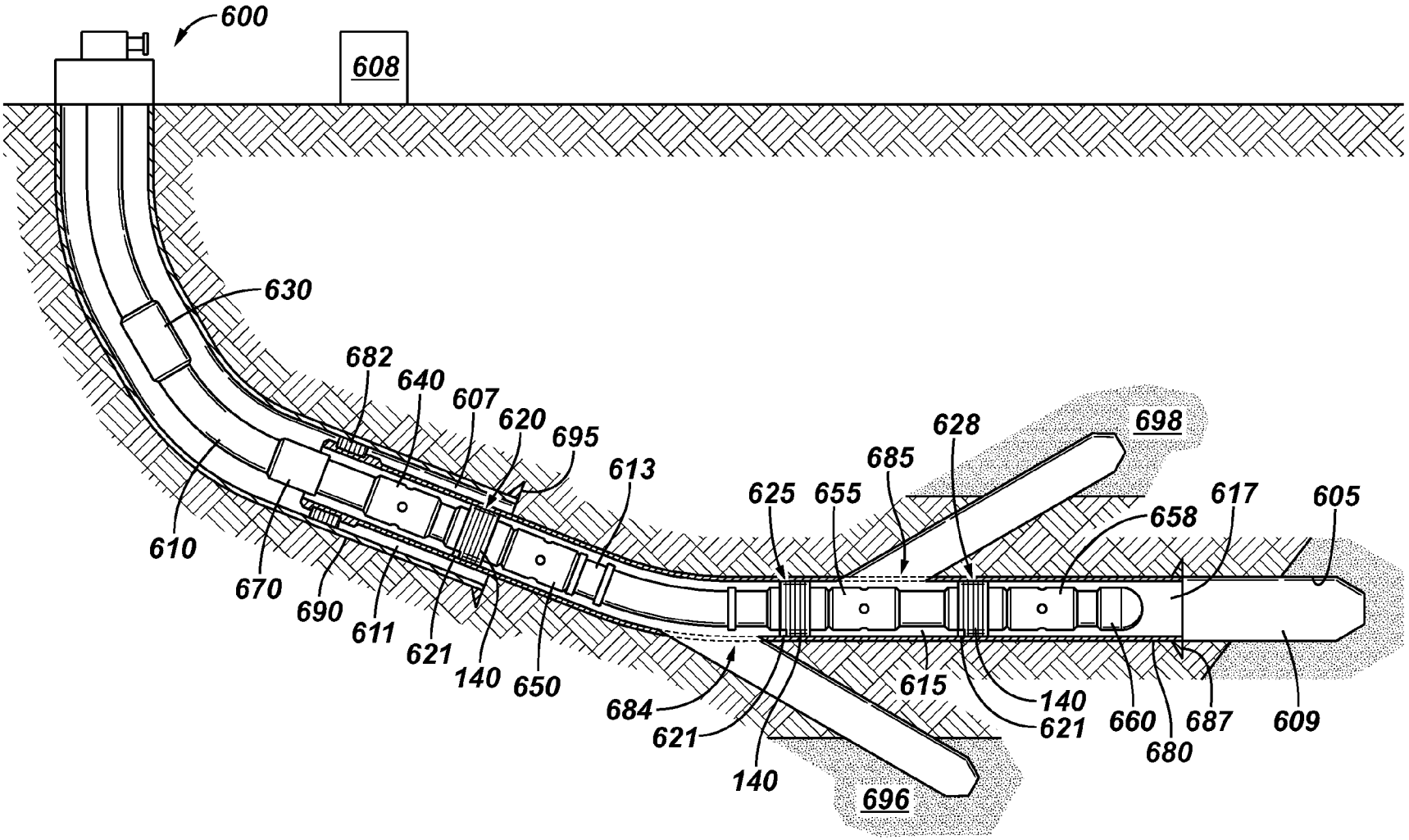
FIG. 6 depicts a schematic view of another illustrative system located within a wellbore, according to one or more embodiments described.

FIG. 6 depicts a schematic view of another illustrative system 600 located within a wellbore 605, according to one or more embodiments. The system 600 can include one or more tubular members 610 having one or more packers (three are shown 620, 625, 628) disposed thereabout. Each packer 620, 625, 628 can include one or more sensors 621. At least one or more flow control valves (three are shown 650, 655, 658) can be disposed about the tubular member 610 for selectively providing fluid communication between an inner diameter of the tubular member 610 and the wellbore 605. The tubular member 610 can also have one or more electric gauges 670 disposed thereabout for measuring one or more properties of the wellbore 605. The tubular member 610 can have a valve 640 disposed thereabout or integrated therewith for providing a selective flow path between a casing string 690 and the inner diameter of the tubular member 610. The tubular member 610 can also have one or more flow control valves 660 disposed at a terminal end thereof, and the flow control valve 660 can selectively allow or prevent flow into or out of the tubular member 610 at the terminal end. A sub-surface safety valve 630 can be disposed about the tubular member 610 between the surface of the wellbore 605 and the electric gauge 670.

The packers 620, 625, 628 can be actuated to selectively isolate one or more zones of the wellbore 605. For example, an "upper" or first packer 620 can isolate an "upper" or first portion 607 of the wellbore 605 from other portions of the wellbore 605; the first packer 620 and an "intermediate" or second packer 625 can isolate a portion of the wellbore 605 therebetween from other portions of the wellbore 605; the second packer 625 and a "lower" or third packer 628 can isolate a portion of the wellbore 605 therebetween from other portions of the wellbore 605; and the third packer 628 can isolate a "lower" portion 609 of the wellbore 605 from other portions of the wellbore 605. Accordingly, when the packers 620, 625, 628 are set within the wellbore 605, the wellbore 605 can be divided into four distinct zones 611, 613, 615, 617.

The zones 611, 613, 615, 617 can be independently monitored, treated, and/or produced using the system 600. The packers 620, 625, 628 can be or include swellable packers, compression or cup packers, inflatable packers, "control line bypass" packers, polished bore retrievable packers, other downhole packers, or combinations thereof. The packers 620, 625, 628 can be made from or include the swellable element 140. For example, at least a portion of the packers 620, 625, 628 can be made from the swellable element 140, the packers 620, 625, 628 can be made completely from the swellable element 140, the swellable element 140 can be inserted into the packers 620, 625, 628, or the swellable element 140 can otherwise be integrated with the packers 620, 625, 628. The sensors 621 can be integrated with the packers 620, 625, 628 by disposing the sensors 621 within or about the swellable element 140.

The sensors 621 can be or include strain gauges, pressure gauges, accelerometers, other sensors described herein, or other monitoring devices. The sensors 621 can be configured to monitor the performance of the packers 620, 625, 628. The sensors 621 can monitor the setting, swelling, and sealing of the packers 620, 625, 628. For example, the sensors 621 can sense the displacement and force exerted upon the packers 620, 625, 628 and the rate of swell of each of the packers 620, 625, 628 as the packers 620, 625, 628 are set. The sensors 621 can also measure pressure differentials about the packers 620, 625, 628 to monitor the seal of each of the packers 620, 625, 628 after the packers 620, 625, 628 are set. The sensors 621 can be in two way communication with one or more control and/or monitoring systems 608 located adjacent the wellbore 605 or remote from the wellbore 605 using wired or wireless telemetry. For example, the sensors 621 can monitor the rate of swell of the packers 620, 625, 628 and transmit the measured data through one or more communication lines to the control and/or monitoring system 608. In one or more embodiments, the sensors 621 can transmit the measured data using wireless telemetry. The communication lines can be electrical wires, fiber optic cables, or the like. The wireless telemetry can be or include acoustic waves, pressure waves, electromagnetic waves, radio frequency transmission, or the like.

The flow control valves 650, 655, 658 can be located adjacent or within one or more of the zones 613, 615, 617 and selectively opened to provide fluid communication between the zones 613, 615, 617 and the inner diameter of the tubular member 610. For example, an "upper" or first flow control valve 650 can be disposed about or integrated with the tubular member 610 and located within the zone 613; an "intermediate" or second flow control valve 655 can be disposed about or integrated with the tubular member 610 and located within the zone 615; and a "lower" or third flow control valve 658 can be disposed about or integrated with the tubular member 610 and located within the zone 617. The flow control valves 650, 655, 658 can be sliding sleeves, ball valves, check valves, or the like. The flow control valves 650, 655, 658 can be actuated independent of one another or concurrent with one another. The flow control valves 650, 655, 658 can be remotely actuated to open and/or close. For example, the flow control valves 650, 655, 658 can be in communication with the control and/or monitoring system 608 and the control and/or monitoring system 608 can send one or more signals to one or more of the flow control valves 650, 655, 658 instructing the flow control valves 650, 655, 658 to open and/or close. The signals can be sent using wireless telemetry and/or through one or more communication lines.

The valve 640 can be disposed about or integrated within the tubular member 610 and located within the zone 611. The valve 640 can be selectively opened to provide a flow path between the inner diameter of the tubular member 610 and the casing string 690. The valve 640 can be actuated or selectively "opened" and/or "closed" from the surface and/or from one or more signals sent to the valve 640 from another portion of the system 600. For example, electric gauge 670 can send a signal to the valve 640 instructing the valve 640 to open when pressure within the wellbore 605 is too high or another predetermined condition is detected. The valve 640 can be an electric sliding sleeve, an electric circulating valve, a remotely operated diverter valve, or any other remotely operated valve or flow control device. The valve 640 can be configured to be actuated from hydraulic pressure in a hydraulic line, signals sent from one or more communication lines in communication with the valve 640 and the control and/or monitoring system 608, or by wireless telemetry.

The electric gauge 670 can monitor one or more properties of the wellbore 605. The electric gauge 670 can be a quartz downhole gauge that can continuously or intermittently measure pressure and temperature of the wellbore 603, a pressure gauge, a temperature gauge, a flow meter, fluid composition or the like. The electric gauge 670 can transmit measured data to the one or more portions or parts of the system 600 and/or to the control and/or monitoring system 608. For example, the electric gauge 670 can continuously or intermittently monitor the pressure within the wellbore 605 and when the pressure in the wellbore is out of a safe range the electric gauge 670 can transmit a signal to the subsurface safety valve 630 and to the control and/or monitoring system 608. The signal can be transmitted using wireless telemetry or one or more communications lines.

The sub-surface safety valve 630 can isolate the wellbore 605 and/or a portion of the tubular member 610 disposed within the wellbore 605 in the event of any system failure, damage to the surface production-control facilities (not shown), or detection of one or more predetermined conditions within the tubular member 610 and/or the wellbore 605. The sub-surface safety valve 630 can be a ball type safety valve, a flapper type safety valve, or the like. The sub-surface safety valve 630 can include an electric actuator that can selectively open and close the sub-surface safety valve 630. For example, if the electric gauge 670 measures a pressure outside of the safe range, the electric gauge 670 can send a signal to electric actuator, and the electric actuator can close the sub-surface safety valve 630. The sub-surface safety valve 630 can be in communication with the electric gauge 670; subsurface monitoring systems (not shown) disposed about the tubular member 610 or otherwise integrated with the system 600; and/or the control and/or monitoring system 608.

The flow control valve 660 can be disposed about the terminal end of the tubular member 610 and located within the zone 617. The flow control valve 660 can be remotely operated to selectively provide a flow path between the zone 617 and the inner diameter of the tubular member 610. The flow control valve 660 can be a poppet valve, a rotatable valve, a sliding sleeve, or another valve. In one or more embodiments, the flow control valve 660 can be actuated to provide and/or prevent fluid flow between the inner diameter of the tubular member 610 and the zone 617 by wireless telemetry or a signal sent through one or more communication lines. For example, the sensor 621 within the third packer 628 can send a signal through wireless telemetry to the flow control valve 660 when the packer 628 is set. The flow control valve 660 can also be in communication with the control and/or monitoring system 608 and/or one or more subsurface control and/or monitoring systems (not shown) located about various locations along the tubular member 610, and the control and/or monitoring system 608 and/or the one or more subsurface control and/or monitoring systems can send one or more signals to the flow control valve 660 instructing the flow control valve 660 to provide and/or prevent fluid communication between the zone 617 and the inner diameter of the tubular member. For example, a subsurface monitoring device or system (not shown) can be located adjacent the zone 617 and the subsurface monitoring device or system (not show) can detect when water and or gas is present in the zone 617. The subsurface monitoring device or system can transmit a signal to the flow control valve 660 instructing the flow control valve 660 to prevent fluid communication between the zone 617 and the inner diameter of the tubular member 610.

In operation, the casing string 690 with a casing shoe 695 located at a terminal end thereof, preferably the terminal end distal the surface, can be conveyed into a portion of the wellbore 605. The wellbore 605 can be a horizontal, vertical, deviated, or other wellbore. The casing string 690 can be cemented or otherwise secured within the wellbore 605. A liner 680 can be secured to the casing string 690 by a liner hanger 682, and the liner 680 can extend into the at least a portion of the wellbore 605. The liner 680 can have one or more perforated or otherwise opened portions (two are shown 684, 685) and a liner shoe 687. The liner shoe 687 can be located at the terminal end of the liner 680. The liner 680 can be located within the wellbore 605 such that the opened portions 684, 685 are located adjacent hydrocarbon bearing zones 696, 698 respectively. The liner 680 can support the wellbore 605 and isolate formations adjacent the wellbore 605 that are aligned with the solid portions of the liner 680. The tubular member 610 can be conveyed into the inner diameter of the casing string 690 and the liner 680 and located within the wellbore 605.

The packers 620, 625, 628 can be set after the tubular member 610 is properly located within the wellbore 605. The sensors 621 can monitor the swell rate and setting of the packers 620, 625, 628 as the packers 620, 625, 628 are set. The sensors 621 can transmit the measured data to the control and/or monitoring system 608. The control and/or monitoring system 608 can provide an alert signal if there is a problem encountered during the setting and/or swelling of the packers 620, 625, 628. The set packers 620, 625, 628 can isolate the zones 613, 615, 617 from one another. The sensors 621 can send a signal to the control and/or monitoring system 608 and the control and/or monitoring system 608 can actuate one or more of the flow control valves 650, 655, 658, 660 and/or the valve 640 once the packers 620, 625, 628 are set properly. The sensors 621 can continuously or intermittently monitor the seal of the set packers 620, 625, 628 and can transmit the measured data to the control and/or monitoring system 608. The control and/or monitoring system 608 can close one or more of the flow control valves 650, 655, 658, 660 and/or the valve 640 if one or more packers 620, 625, 628 fail.

The zone 615 can be in fluid communication with the hydrocarbon bearing zone 698. As such, the second flow control valve 658 can provide selective fluid communication between the hydrocarbon bearing zone 698 and the inner diameter of the tubular member 610. The zone 613 can be in fluid communication with the hydrocarbon bearing zone 696. The first flow control valve 650 can provide selective fluid communication between the hydrocarbon bearing zone 696 and the inner diameter of the tubular member 610. The third flow control valve 658 and the flow control device 660 can be located within the zone 617 and selectively provide fluid communication between the zone 617 and the inner diameter of the tubular member 610. The valve 640 can be located within the zone 611 and selectively provide fluid communication between the zone 611 and the inner diameter of the tubular member 610.

The system 600 can independently monitor and/or control the flow of fluid and/or hydrocarbons into and/or out of the zones 611, 613, 615, 617. For example, the system 600 can have subsurface monitoring equipment (not shown) located within each zone 613, 615, 617; the electric gauge 670 can monitor the zone 611, and the sensors 621 can monitor the seal of the packers 620, 625, 628. One or more of the flow control valves 650, 655, 658, 660 and/or the valve 640 can be selectively opened and/or closed to control the flow of fluid and/or hydrocarbons into and/or out of the zones 613, 615, 617, 619. For example, if a problem is detected in the zone 613, but the zones 615, 617 are functioning properly, the first flow control valve 650 can be closed and the flow control valves 655, 658, 660 can be opened.

Figure 7:
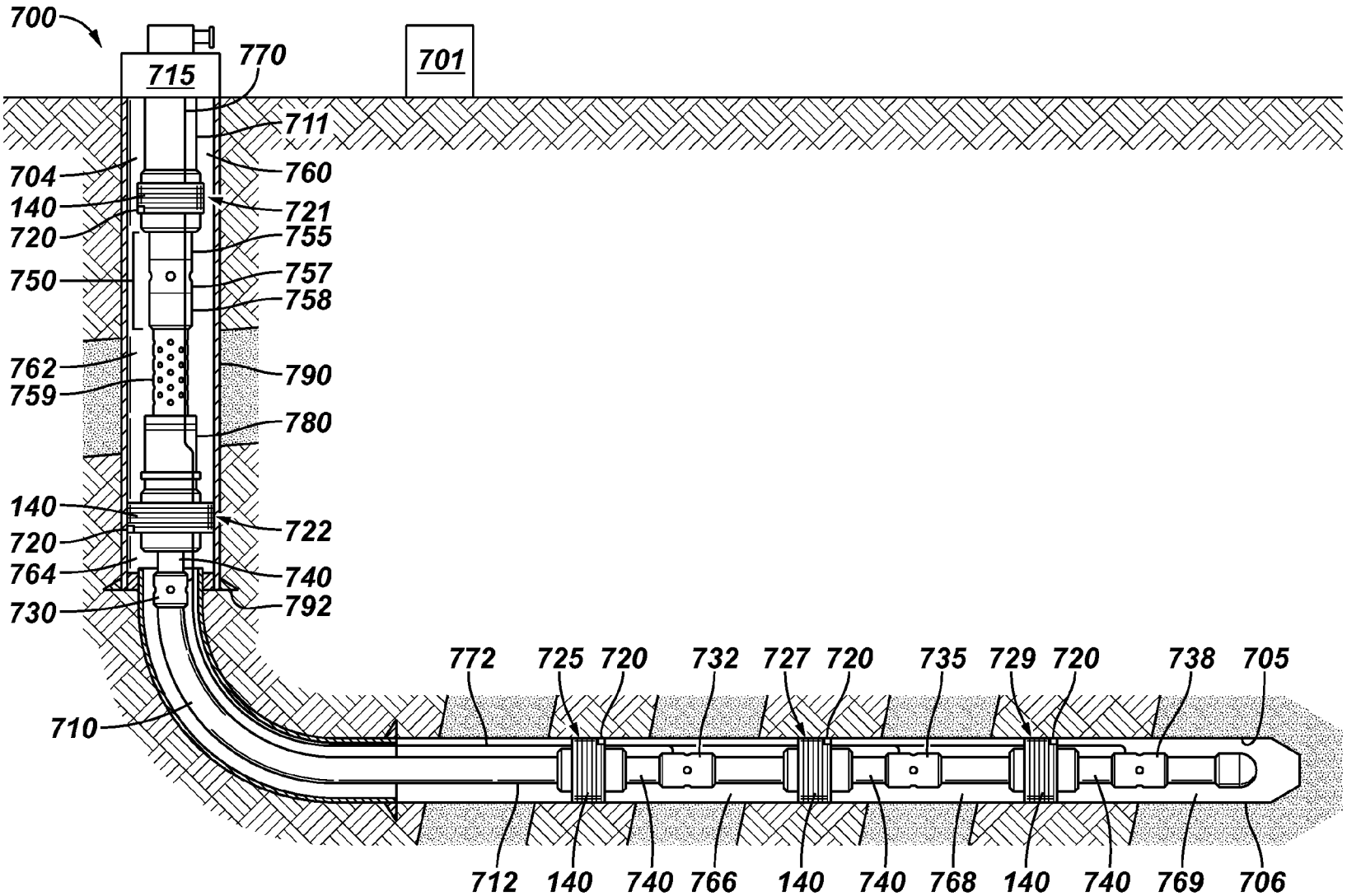
FIG. 7 depicts a schematic view of an illustrative system located within a wellbore, according to one or more embodiments described.

FIG. 7 depicts a schematic view of an illustrative system 700 located within a wellbore 705, according to one or more embodiments. The system 700 can include a tubular member 710 having one or more packers (five are shown 721, 722, 725, 727, 729) disposed thereabout. The packers 721, 722, 725, 727, 729 can include one or more sensors 720 integrated therewith. The system 700 can also include one or more flow control valves (four are shown 730, 732, 735, 738), which can selectively provide fluid communication between the wellbore 705 and an inner diameter of the tubular member 710. The tubular member 710 can also include or more electrical submersible pump systems 750 and one or more wet connects 780. One or more subsurface monitoring systems 740 can be integrated with the system 700 for independently monitoring one or more portions of the wellbore 705.

The packers 721, 722, 725, 727, 729 can be actuated or swelled to selectively isolate one or more zones of the wellbore 705. The packers 721, 722, 725, 727, 729 can be or include swellable packers, compression or cup packers, inflatable packers, "control line bypass" packers, polished bore retrievable packers, other downhole packers, or combinations thereof. The packers 721, 722, 725, 727, 729 can be made from or include the swellable element 140. For example, at least a portion of the packers 721, 722, 725, 727, 729 can be made from the swellable element 140; the packers 721, 722, 725, 727, 729 can be made completely from the swellable element 140; the swellable element 140 can be inserted into the packers 721, 722, 725, 727, 729; or the swellable element 140 can otherwise be integrated with the packers 721, 722, 725, 727, 729. The sensors 720 can be integrated with the packers 620, 625, 628 by disposing the sensors 720 within the swellable element 140.

The packers 721, 722, 725, 727, 729 can have pressure-isolated ports. The pressure-isolated ports allow passage of one or more communication lines 770, 772 to the electrical submersible pump systems 750, the wet connect 780, the sensors 720, the flow control valves 730, 732, 735, 738, and other portions of the system 700. The communication lines 770, 772 can include one or more hydraulic lines, fiber optic lines, and/or electrical lines. The communication line 770 can be disposed about an "upper" or first portion 711 of the tubular member 710 and the communication lines 772 can be disposed about a "lower" or second portion 712 of the tubular member 710.

The wet connect 780 can connect the communication lines 772 with the communication lines 770. The wet connect 780 can be any wet connect configured to join hydraulic lines, electrical lines, fiber optic lines, and/or other communications lines together. An illustrative wet connect 780 is described in more detail in US Patent Publication No. 2009/0078429A1.

The packers 721, 722, 725, 727, 729 divide the wellbore 705 into six independent zones or regions 760, 762, 764, 766, 768, 769 by isolating portions of the wellbore 705 from one another. For example, an "upper" or first packer 721 can isolate an "upper" or first portion 704 of the wellbore 705 from other portions of the wellbore 705. The first packer 721 and a second packer 722 can isolate a portion of the wellbore 705 therebetween from other portions of the wellbore 705. The second packer 722 and a third packer 725 can isolate a portion of the wellbore 705 therebetween from other portions of the wellbore 705, the third packer 725 and a fourth packer 727 can isolate a portion of the wellbore 705 therebetween from other portion of the wellbore 705; the fourth packer 727 and a "lower" or fifth packer 729 can isolate a portion of the wellbore 705 therebetween from other portions of the wellbore 705; and the fifth packer 729 can isolate a "lower" portion 706 of the wellbore 705 from other portions of the wellbore 705.

The sensors 720 can be or include strain gauges, pressure gauges, accelerometers, other sensors described herein, or other downhole gauges and sensors. The sensors 720 can be configured to monitor the setting, swelling, and sealing of the packers 721, 722, 725, 727, 729. For example, the sensors 720 can sense the displacement and/or force exerted upon the packers 721, 722, 725, 727, 729 and/or the rate of swell of each of the packers 721, 722, 725, 727, 729 as the packers 721, 722, 725, 727, 729 are set. The sensors 720 can also measure pressure differentials about the packers 721, 722, 725, 727, 729 to monitor the seal of each of the packers 721, 722, 725, 727, 729 after the packers 721, 722, 725, 727, 729 are set. The sensors 720 can transmit measured data back to one or more control and/or monitoring systems 701 located adjacent to or remote from the wellbore 705 using communication lines 770, 772 and/or wireless telemetry. For example, the sensors 720 can monitor the rate of swell of the packers 721, 722, 725, 727, 729 and transmit the measured data through communication lines 770, 772 to the control and/or monitoring system 701. In one or more embodiments, the sensors 720 can transmit the measured data using wireless telemetry. The wireless telemetry can be or include acoustic waves, pressure waves, electromagnetic waves, radio frequency transmission, or the like.

The flow control valves 730, 732, 735, 738 can be located adjacent or within one or more of the zones 760, 762, 764, 766, 768, 769 and selectively opened to provide fluid communication between the zones 760, 762, 764, 766, 768, 769 and the inner diameter of the tubular member 710. For example, an "upper" or first flow control valve 730 can be disposed about or integrated with the tubular member 710 and located within the zone 764; a second flow control valve 732 can be disposed about or integrated with the tubular member 710 and located within the zone 766; a third flow control valve 735 can be disposed about or integrated with the tubular member 710 and located within the zone 768; and a "lower" or fourth flow control valve 738 can be disposed about or integrated with the tubular member 710 and located within the zone 769. The flow control valves 730, 732, 735, 738 can be sliding sleeves, ball valves, check valves, or the like. The flow control valves 730, 732, 735, 738 can be in communication with the communication lines 772.

The flow control valves 730, 732, 735, 738 can be actuated independent of one another or concurrent with one another. The flow control valves 730, 732, 735, 738 can be remotely actuated to open and/or close. For example, the flow control valves 730, 732, 735, 738 can be in communication with the control and/or monitor system 701 and the control and/or monitor system 701 can send one or more signals to one or more of the flow control valves 730, 732, 735, 738 instructing the flow control valves 730, 732, 735, 738 to open and/or close. The signals can be sent using wireless telemetry and/or through one or more communication lines 770, 772.

The electrical submersible pump system 750 can provide a lift method to improve the production of the wellbore 705. The electrical submersible pump system 750 can include a pump 755, a pump intake 757, and a motor 758. The pump 755 can be a multistage centrifugal pump. The stages of the pump 755 can include a rotating impeller and a stationary diffuser. The stages can be made from any material. Illustrative materials include Ni-Resist, Ryton, or other materials that can withstand the conditions of the wellbore 705. The pump 755 can have a shaft that is driven by the motor 758.

The motor 758 can be a two-pole, three-phase, squirrelcage induction type electric motor. The motor 758 can be cooled as hydrocarbons and/or other fluids within the wellbore 705 flow by a housing of the motor 758. One or more sensors can be integrated with the motor 758, and the sensors can sense one or more conditions of the motor 758 and/or the wellbore 705. For example, the sensors can monitor the temperature of the motor 758 and the temperature of the wellbore 705. The motor 758 can be at least partially disposed within a perforated tubing 759. The perforated tubing 759 can allow hydrocarbons and/or other fluids flowing within the tubular member 710 to flow into zone 762. The hydrocarbons and/or fluids in the zone 762 can flow by a housing of the motor 758 to the pump intake 757. The flow rate through the pump intake 757 can be used to control the flow rate of hydrocarbons and/or fluids being produced from the wellbore 705. The electrical submersible pump system 750 can be in communication with the communication lines 770, 772. For example, the communication lines 770 can provide power to the motor 778, and the electrical submersible pump system 750 can send and or receive signals from other portions of the system 700 via communication lines 770, 772.

The subsurface monitoring system 740 can include one or more sensors and/or gauges distributed about the tubular 710 for measuring and/or acquiring wellbore data at different locations within the wellbore 705. The subsurface monitoring system 740 can measure pressure, temperature, flow rates, and/or vibrations at different locations within the wellbore 705. The data measured by the subsurface monitoring system 740 can be transmitted to the control and/or monitor system 701. For example, the wellbore data measured by the subsurface monitoring system 740 can be transmitted to the control and/or monitoring system 701 by communication lines 770, 772 and/or by wireless telemetry.

In one or more embodiments, the subsurface monitoring system 740 and/or the control and/or monitoring system 701 can be in communication with one or more of the flow control valves 730, 732, 735, 738, and can send a signal to one or more of the flow control valves 730, 732, 735, 738 instructing the flow control valves 730, 732, 735, 738 to open and/or close. Accordingly, the flow control valves 730, 732, 735, 738 can be controlled independent of one another. For example, the flow control valves 730, 732, 735, 738 can be providing fluid communication between the inner diameter of the tubular member 710 and the wellbore 705, and the subsurface monitoring system 740 can send a signal to the flow control valve 732 instructing the flow control valve 732 to prevent fluid communication between the zone 766 and the inner diameter of the tubular member 710 if a predetermined condition is detected within zone 766. The other flow control valves 730, 735, 738 can continue providing fluid communication between the wellbore 705 and the inner diameter of the tubular member 710.

The data measured by the subsurface monitoring system 740, the sensors 720, and the sensors within the motor 758 can be transmitted to the surface through communication lines 770, 772. In one or more embodiments, the data measured by the sensors 720, the subsurface monitoring system 740, and the sensors within the motor can be transmitted to a single location within the wellbore 705, and the data collected at the location can be transmitted to the surface through the communication line 770. For example, data measured by the subsurface monitoring system 740, the sensors 720, and the sensors within the motor 758 can be transmitted to a receiver or processor within the motor 758, and the data can be transmitted through communication lines 770 to the control and/or monitoring system 701.

In operation, the casing string 790 is located within the wellbore 705. The casing string 790 has a casing shoe 792 located at a terminal end thereof, preferably the terminal end distal the surface. The casing string 790 is cemented or otherwise secured within the wellbore 705. The wellbore 705 can be a horizontal, deviated, vertical, or any other type of wellbore. The second portion 712 of the tubular member 710 and the communication lines 772 are conveyed and located within the wellbore 705 after the casing string 790 is secured within the wellbore 705. The communication lines 772 can be in communication with the subsurface monitoring system 740, the sensors 720 within the packers 722, 725, 727, 729, and/or the flow control devices 730, 732, 735, 738. The packers 722, 725, 727, 729 are set after the second portion 712 of the tubular member 710 is properly located within the wellbore 705. The sensors 720 can monitor the swell and setting of the packers 722, 725, 727, 729 as the packers 722, 725, 727, 729 are set within the wellbore 705.

The first portion of the tubular member 710 and the communication lines 770 are conveyed into the wellbore 705 concurrently with the setting of the packers 722, 725, 727, 729 or subsequent to the setting of the packers 722, 725, 727, 729. The wet connect 780 can connect the communication lines 770, 772 together, which provides communication between the communication lines 770, 772. The first packer 721 can be set after the first portion 711 of the tubular member 710 is properly located within the wellbore 705. The first portion 711 of the tubular member 710 can be connected with a Christmas tree 715 after the being located within the wellbore 705. The Christmas tree 715 can include an assembly of valves, spools, pressure gauges and chokes fitted to control production of fluid from the wellbore 705.

The set packers define the zones 760, 762, 764, 766, 768, 769. The sensors 720 within in the packers 721, 722, 725, 727, 729 can continuously or intermittently measure the seal of the respective packers 760, 762, 764, 766, 768, 769 after the packers 760, 762, 764, 766, 768, 769 are set. The subsurface monitoring system 740 can independently monitor the zones 764, 766, 768, 769, and the sensors within the motor 758 can monitor the zone 762. The zone 760 can be monitored by the Christmas tree 715 and/or other sensors and equipment (not shown) proximate or adjacent the zone 760.

The flow control devices 730, 732, 735, 738 can be opened after the tubular member 710 is located in the wellbore and the packers 721, 722, 725, 727, 729 are set. The electrical submersible pump assembly 750 can be actuated to provide lift to hydrocarbons flowing from the wellbore 705 through the flow control valves 730, 732, 735, 738 to the inner diameter of the tubular member 710. The subsurface monitoring system 740, the sensors within the motor 758, and the sensors 720 can continuously or intermittently monitor the wellbore 705 and communicate the measured data to the control and/or monitoring system 701. Fluid communication between one or more of the zones 764, 766, 768, 769 and the inner diameter of the tubular member 710 can be selectively allowed and/or prevented. For example, the flow control valves 730, 732, 735 can prevent fluid communication between the zones 764, 766, 768, and the flow control valve 738 can allow fluid communication between the inner diameter of the tubular member 710 and the zone 769. During production, fluid communication between the inner diameter of the tubular member 710 and the zones 764, 766, 768, 769 can be selectively prevented if a pressure differential between one or more of the zones 764, 766, 768, 769 is to high, one of the packers isolating one or more of the zone fails; a predetermined condition is detected in one or more zones, and/or the like.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for deploying one or more sensors into a wellbore comprising:
   - at least partially embedding the one or more sensors in one or more swellable elements having a channel formed thereinto, the one or more sensors having a portion exposed to the channel and a portion isolated by the swellable element;
   - conveying the one or more sensors and the one or more swellable elements into the wellbore;
   - at least partially swelling one or more of the swellable elements for engaging a wall of the wellbore while allowing fluid communication between the channel and the wellbore; and
   - measuring at least one wellbore property with the one or more sensors via the channel during the engaging.

2. The method of claim 1, the conveying step further comprising measuring at least one wellbore property with the one or more sensors.

3. The method of claim 1, wherein the one or more swellable elements are disposed about a tubular member prior to the conveying step.

4. The method of claim 1, further comprising exposing at least a first portion of at least one of the sensors to a wellbore fluid and isolating a second portion of the at least one sensor from the wellbore fluid.

5. The method of claim 1, wherein the one or more sensors are a plurality of sensors.

6. The method of claim 5, further comprising:
   - completely isolating at least one of the plurality of the sensors in one of the swellable elements;
   - exposing at least a portion of one of the plurality of sensors; and
   - exposing at least another one of the plurality of sensors to a portion of the wellbore and wherein the swelling step isolates the portion of the wellbore from at least one other portion of the wellbore.

7. An apparatus for measuring at least one property of a wellbore comprising:
   - a swellable element for engaging a wall of the wellbore and having a channel formed thereinto;
   - a sensor at least partially encapsulated by the swellable element during the engaging for isolating a portion thereof, another portion of said sensor in fluid communication with the wellbore via the channel during the engaging; and
   - a control line connected to the sensor.

8. The apparatus of claim 7, further comprising a plurality of sensors disposed within the swellable element.

9. The apparatus of claim 8, further comprising:
   - a first notch formed into a first portion of the swellable element;
   - a second notch formed into a second portion of the swellable element;
   - a first sensor disposed within the first notch;
   - a second sensor disposed within the second notch; and
   - a third sensor disposed between the first sensor and second sensor, wherein the third sensor is completely encapsulated by the swellable element, and wherein the control line is connected with each of the sensors.

10. The apparatus of claim 8, further comprising two sensors disposed within the swellable element, wherein the two sensors are both aligned along a single axis substantially parallel to the long axis of the wellbore.

11. The apparatus of claim 7, wherein the sensor is connected in series with another sensor.

12. The apparatus of claim 7, wherein the sensor is at least one of a temperature sensor, a pressure sensor, a pH sensor, an accelerometer, or a strain gauge.

13. The apparatus of claim 7, further comprising the sensor disposed within a notch formed into a first portion of the swellable element.

14. A system for measuring at least one property of a wellbore comprising:

a tubular member;

at least two packers disposed about the tubular member for engaging a wall of the wellbore, wherein each packer comprises a swellable element having a channel formed thereinto at least one sensor disposed therein, the sensor having a portion isolated during the engaging and another portion in fluid communication with the wellbore via the channel during the engaging; and at least one of a control system and a monitoring system, wherein the sensors are in communication with the control system, the monitoring system, or both.

15. The system of claim 14, further comprising a flow control device disposed between the packers.

16. The system of claim 14, further comprising a multi-port packer disposed about the tubular member.

17. The system of claim 14, further comprising a subsurface monitoring system disposed between the packers.

18. The system of claim 14, wherein the sensors measure at least one of the setting, swelling, and sealing of the packer within which the sensor is disposed.

19. The system of claim 14, further comprising an electric valve for selectively providing a circulation flow path between the wellbore and an inner diameter of the tubular member.

* * * * *